US005320021A

United States Patent [19]

Heintz

[11] Patent Number: 5,320,021

[45] Date of Patent: Jun. 14, 1994

[54] UNIVERSAL CHAIN WRENCH AND TOOLS

[76] Inventor: Farrell E. Heintz, 3319 B S. Monaco Pkwy., Denver, Colo. 80222

[21] Appl. No.: 13,783

[22] Filed: Feb. 5, 1993

[51] Int. Cl.[5] ..... B25B 13/52

[52] U.S. Cl. ..... 81/65; 81/65.2; 81/3.43; 81/177.85; 81/177.2; 81/177.7

[58] Field of Search ..... 81/64, 65, 65.2, 68, 81/69, 70, 65.4, 57.33, 57.34, 3.43, 177.1, 177.8, 177.9, 177.2, 177.5, 177.7, 177.75, 177.85

[56] References Cited

U.S. PATENT DOCUMENTS

| | | | |
|---|---|---|---|
| 855,380 | 5/1907 | Bates | 81/65 |
| 1,456,290 | 5/1923 | Tell | 81/177.85 X |
| 2,825,253 | 3/1958 | Brenner | 81/68 |
| 2,932,226 | 4/1960 | Seppola | 81/65 X |
| 3,597,776 | 8/1971 | Saunders | 81/68 X |
| 3,880,024 | 4/1975 | Asada | 81/65 X |
| 4,987,804 | 1/1991 | Greenawalt | 81/64 |

*Primary Examiner*—D. S. Meislin

*Attorney, Agent, or Firm*—Edwin H. Crabtree; Donald W. Margolis

[57] ABSTRACT

A chain wrench for engagement around a circumference of a threaded workpiece such as a pipe and the like and disposed at a right angle to the length of the workpiece. The chain wrench may be used for tightening the threaded workpiece on a threaded coupler or used for loosening the threaded workpiece on the threaded coupler. The chain wrench includes a chain wrench body with the front of wrench body having a plurality of teeth for releasably engaging and gripping of the workpiece. A first end of a chain is adapted for tightening on wrench body. A second end of the chain is releasably mounted on the wrench body so that a length of the chain can be adjusted when received around different sizes of the workpiece. The wrench body further includes a first attachment block extending upwardly from the top of the wrench body. The first attachment block is adapted for receiving one end of a handle. When the handle is secured to first attachment block, the handle may be disposed at a right angle to the length of the workpiece, parallel to the length of the workpiece and at an angle to the length of the workpiece. The wrench body also includes a second attachment block extending downwardly from the bottom wrench body. When a pair of the subject chain wrenches are secured to the workpiece and to the threaded coupler, the second attachment blocks are used to receive utility attachment blocks connected a utility bolt. When the bolt is tightened the workpiece can be loosened or tightened on the coupler.

12 Claims, 6 Drawing Sheets

UNIVERSAL CHAIN WRENCH AND TOOLS

BACKGROUND—FIELD OF INVENTION

This invention relates to pipe wrenches, specifically to chain type pipe wrenches and tools used in turning threaded pipe.

BACKGROUND—DESCRIPTION OF PRIOR ART

Plumbers and many others commonly use a pipe wrench for turning pieces of threaded pipe. In most cases conventional chain wrenches or pipe wrenches can be used to achieve their specific task. However, there are times when they cannot achieve their specific task due to close in type conditions or trying to free or tighten a threaded pipe connection due to the fact that they are working alone.

When working with a conventional type chain wrench or pipe wrench, I though skilled in using such tools, would often have additional tools to do the job and often fail due to the existing surroundings or the lack of having another person to help achieve the specific task.

Furthermore, inventors have made the pipe or wrenches in many different forms in order to meet more of the conditions being encountered in the field. They have made the Adjustable Wrench, U.S. Pat. No. 5,040,439 to Chapman (1991) showing a chain tightener with a attached handle. Also, U.S. Pat. No. 3,505,914 (1970) showing a spring-biased hook to keep the chain tightened with a attached handle. However, both of these patents referenced here have a attached handle with a fixed length and a unchangeable position to which the handle is physically part of the wrench.

Thus if a person should need to have the handle a different length or positioned differently in order to perform their task, they must use a different wrench which also may or may not work for their specific task.

Although for the most part they will be able to somehow utilize their fixed length and fixed position handle chain wrench that is currently patented, nevertheless they simply will not have the versatility of having one tool for all of their tasks for working on threaded pipe. Furthermore, these fixed length and fixed position handle chain wrenches also require that there is a person for each wrench.

Other types of chain wrenches for working with threaded pipe, U.S. Pat. Nos. 3,805,646 (1974) and 4,171,652 (1979). Although they will do most tasks, they too have fixed length and fixed positioned handles. These fixed length and fixed position handle chain wrenches are only capable of being used when there is plenty of room in order to fit the fixed length and the fixed position of the handle. Nevertheless, all of the previous chain wrenches for threaded pipe fittings in all previous art are known to suffer from a number of disadvantages:

(a) Their handle is physically attached to the jaw of the chain wrench. Thus you can't change the way the handle is attached to the jaw of the wrench in order to make the chain wrench work in different situations.

(b) The handle has a definite length and can not be replaced with a smaller or larger handle in order to fit the specific task. Hence, if you need a small handle in order to fit into a small work space you must have another size chain wrench or if you require to be able to put more torque on the pipe fitting you must use a larger chain wrench.

(c) If one needs to loosen or tighten a pipe fitting they may not be able to do this task on their own. Since, most of the time it requires one person to hold on to one chain wrench which is attached to one piece of pipe in order to keep it from turning at a different joint while yet another person is required to use a second chain wrench which is attached to the other piece of pipe and turn the piece of pipe.

OBJECTS AND ADVANTAGES

Accordingly, besides the objects of the chain wrenches for threaded pipe described heretofore, several objects and advantages of my invention are:

(a) to provide the ability of having a chain wrench with a removable handle;

(b) to provide the ability of being able to change the position to which the handle is position in accordance to the jaw of the chain wrench;

(c) to provide the ability of being able to change the length of the handle that is attached to the chain wrench;

(d) to provide the ability of tightening or loosening threaded pipe fittings without the need of another person to help;

(e) to provide the ability to use the chain wrench in small work areas;

(f) to provide the ability to attach a handle that can be angled away from the wrench at most angles;

(g) to provide the ability of combing handles to fit work conditions.

Further objects and advantages are to provide a chain wrench that is easy to use, versatile, and truly universal.

DRAWING FIGURES

In the drawings, parts that are used in more than one drawing will be shown as the part number that they occurred as before.

FIG. 1 shows an exploded view of the main body of the universal chain wrench in an isometric view.

FIGS. 2*a* to 2*e* shows the main body of the universal chain wrench assembled in multiple views without the chain 105 and the keeper ring 106 shown.

Figures 5A, 5B, 5C, 5D, 5E, 5F, 5G, 5H:
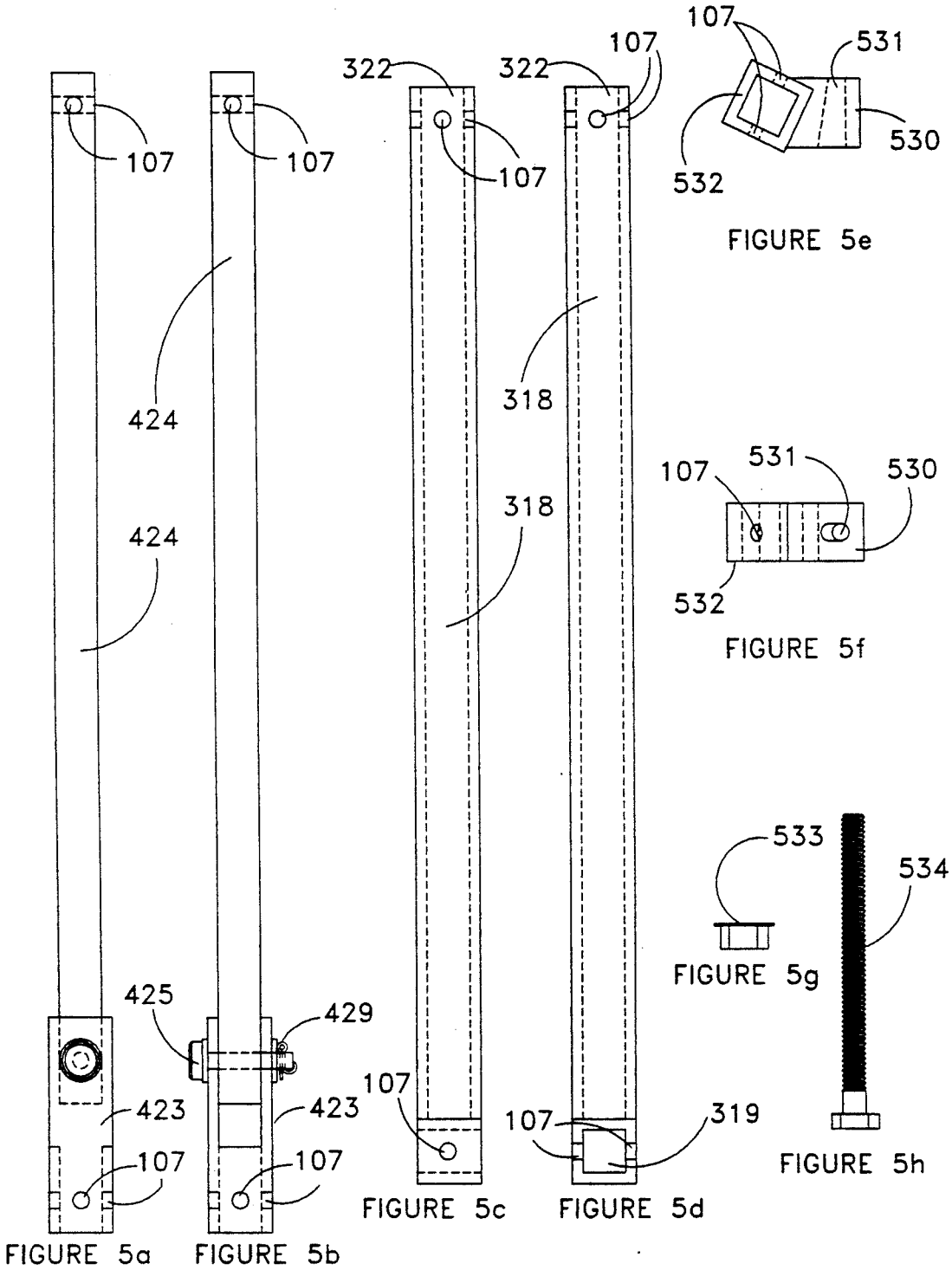

FIGS. 5*a* and 5*b* show the side view and the top view of the universal handle.

FIGS. 5*c* and 5*d* show the side view and the top view of the standard handle.

FIGS. 5*e* and 5*f* show the top view and the front view of the utility block.

FIG. 5*g* shows a side view of the utility nut.

FIG. 5*h* shows the side view of the utility bolt.

Figure 6:
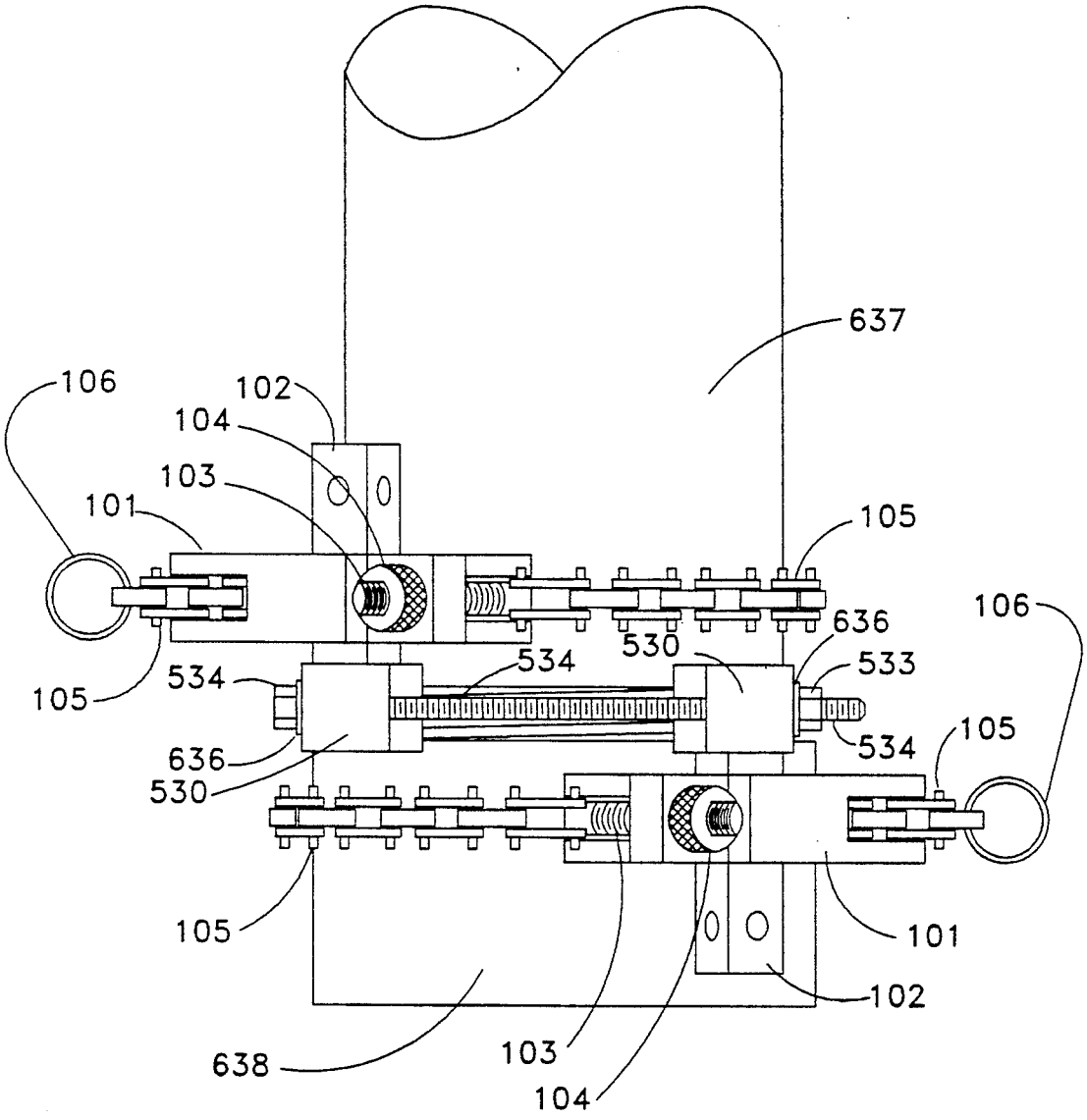

FIG. 6 shows an assembled view of two main bodies of the universal chain wrench attached to a pipe with a coupler. This view shows the two main bodies of the universal chain wrench with each having an utility block with a bolt extending through the utility blocks.

REFERENCE NUMERALS IN DRAWINGS

| | |
|---|---|
| 101 body | 102 attachment block |
| 103 adjustable chain tightener bolt | 104 knurl nut |
| 105 chain | 106 keeper ring |
| 107 attachment pin holes | 108 teeth |
| 109 adjustment bolt groove | 110 adjustment bolt hole |
| 111 chain pin hole | 112 chain pin |
| 113 chain groove | 114 hooks |
| 115 chain link hole | 116 flat bolt surface |
| 117 bolt guide | 318 standard handle |
| 319 attachment hole | 320 cotter key |
| 321 attachment pin | 322 attachment hole |
| 423 flex housing | 424 handle |
| 425 handle pin | 426 handle flat washer |
| 427 flex housing hole | 428 handle hole |
| 429 cotter pin | 530 utility attachment block |
| 531 wobble hole | 532 attachment block housing |
| 533 utility nut | 534 utility bolt |
| | 636 flat washer |
| 637 pipe nipple | 638 pipe coupler |

DESCRIPTION AND OPERATIONS—FIGS. 1 to 6*d*

Figure 1:
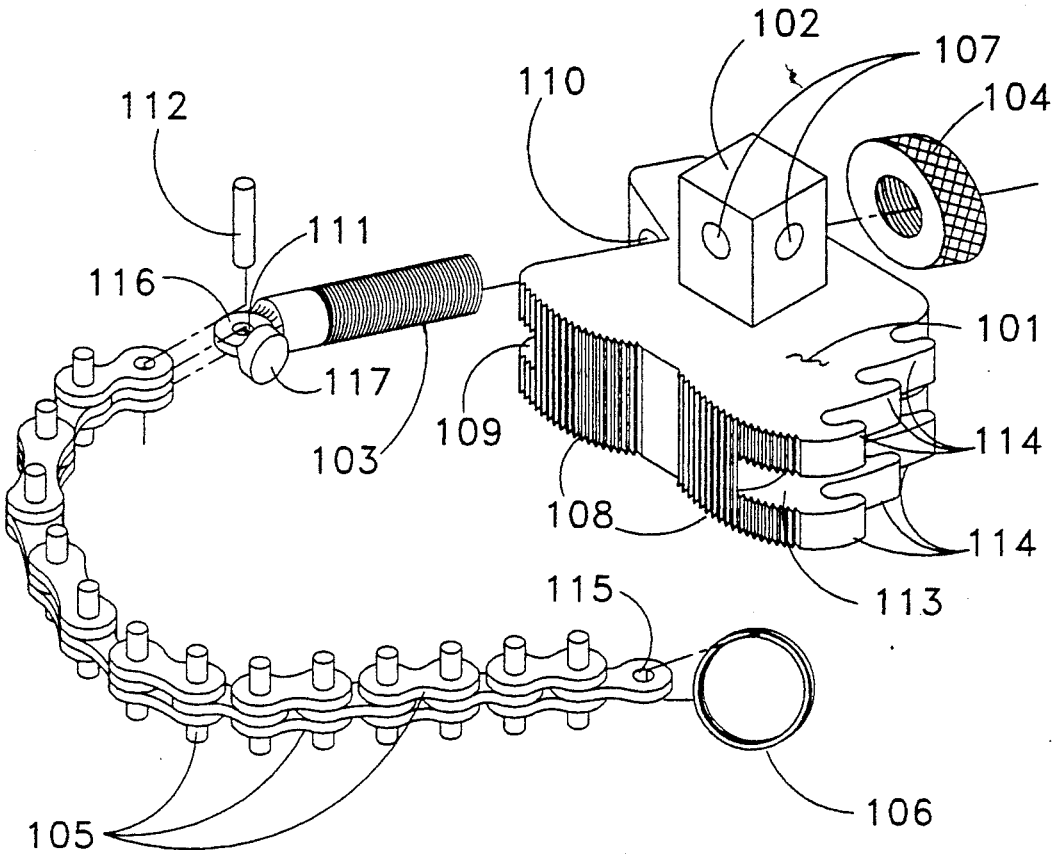

An exploded type isometric view of the main body of the chain wrench is shown in FIG. 1. The main body of the universal chain wrench consists of the body 101, the attachment block 102, the adjustable chain tightener bolt 103, the knurl nut 104, the chain 105, and the keeper ring 106. The attachment block 102 extrudes through the center of the body 101 and is welded in place with equal amounts of attachment block 102 on each side of the body 101. The attachment block 102 has 4 attachment pin holes 107 drilled through it (two in each end) in order to attach other tools that will be mentioned hereafter. The main body 101 has two sets of teeth 108 that are circumscribed about two different arcs. Having these teeth 108 carved out about these arcs allow them to have the ability of being in a more tangential form with the work piece thus allowing only a few teeth 108 to grab onto the work piece. By having only a few teeth 108 come into contact with the work piece, the pressure is applied to the pipe in a more concentrated pattern thus allowing the body 101 to grip the work piece better. When looking at the body 101 from the teeth side, on the left side of the body 101 there is a groove 109 and a hole 110. This groove is to allow the chain 105 and to allow the bolt guide 117 to slip through. The bolt guide 117 is used to keep the bolt from turning. The adjustable chain tightener bolt 103 has two parallel flat surfaces 116 with a chain pin hole 111 drilled through it on the shaft end in order for the first end of the chain 105 to go over top of the flat bolt surfaces 116 and then the chain pin 112 is pushed through the first chain link, through the chain pin hole 111, and finally through the other chain link. Thus attaching the first end of the chain 105 to the adjustable chain tightener bolt 103. Then the adjustable chain tightener bolt is placed through the adjustment bolt hole 110 in such a way that at the same time the bolt guide 117 slips into the adjustment bolt groove 109. Furthermore, once the adjustable chain tightener bolt 103 is in place, the knurl nut 104 is screwed onto the adjustable chain tightener bolt 103. On the right side of the body 101, there is a chain groove 113 that the chain 105 will slip into. Also, there are 6 hooks 114 (3 on the top of the chain groove 113 and 3 on the bottom) extruding from the main block 101 in which the chain pins will slip into thus holding the second end of the chain 105 at which ever set of chain pins are inserted into the hooks 114. Thus allowing the chain to be adjusted for whatever size pipe is to be encountered. Furthermore, there is a keeper ring 106 that goes onto the end of the chain 105 through the chain link hole 115.

Figure 2A:
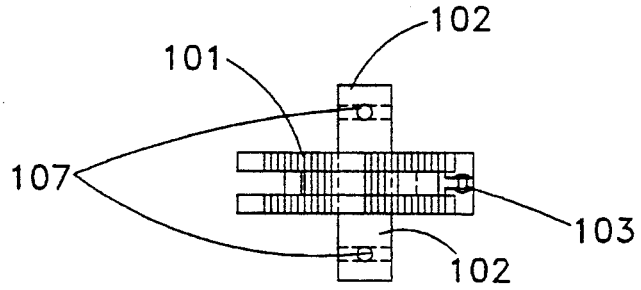
Figure 2B:
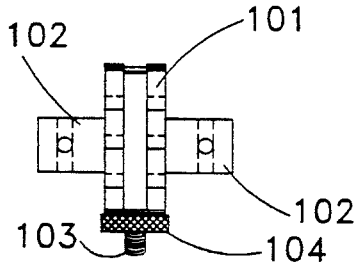
Figure 2C:
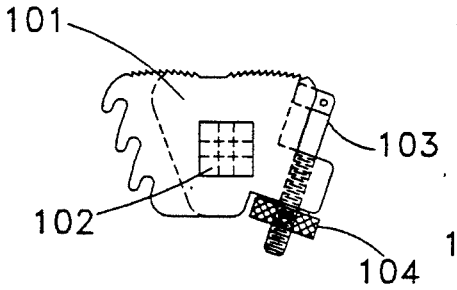
Figure 2D:
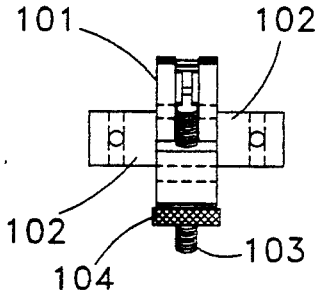
Figure 2E:
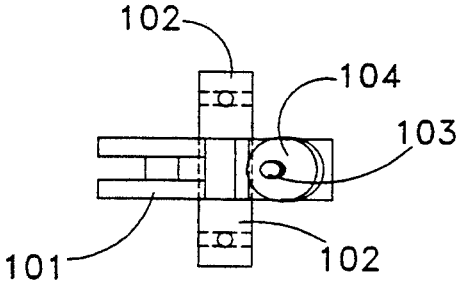

FIGS. 2*a* to 2*e*, these figures show all of the views of the main body without the chain 105 and the keeper ring 106. FIG. 2*a* shows the top view, FIG. 2*b* shows the left side view, FIG. 2*c* shows the front view, FIG. 2*d* shows the right side view, and FIG. 2*e* shows the bottom view.

Figure 3:
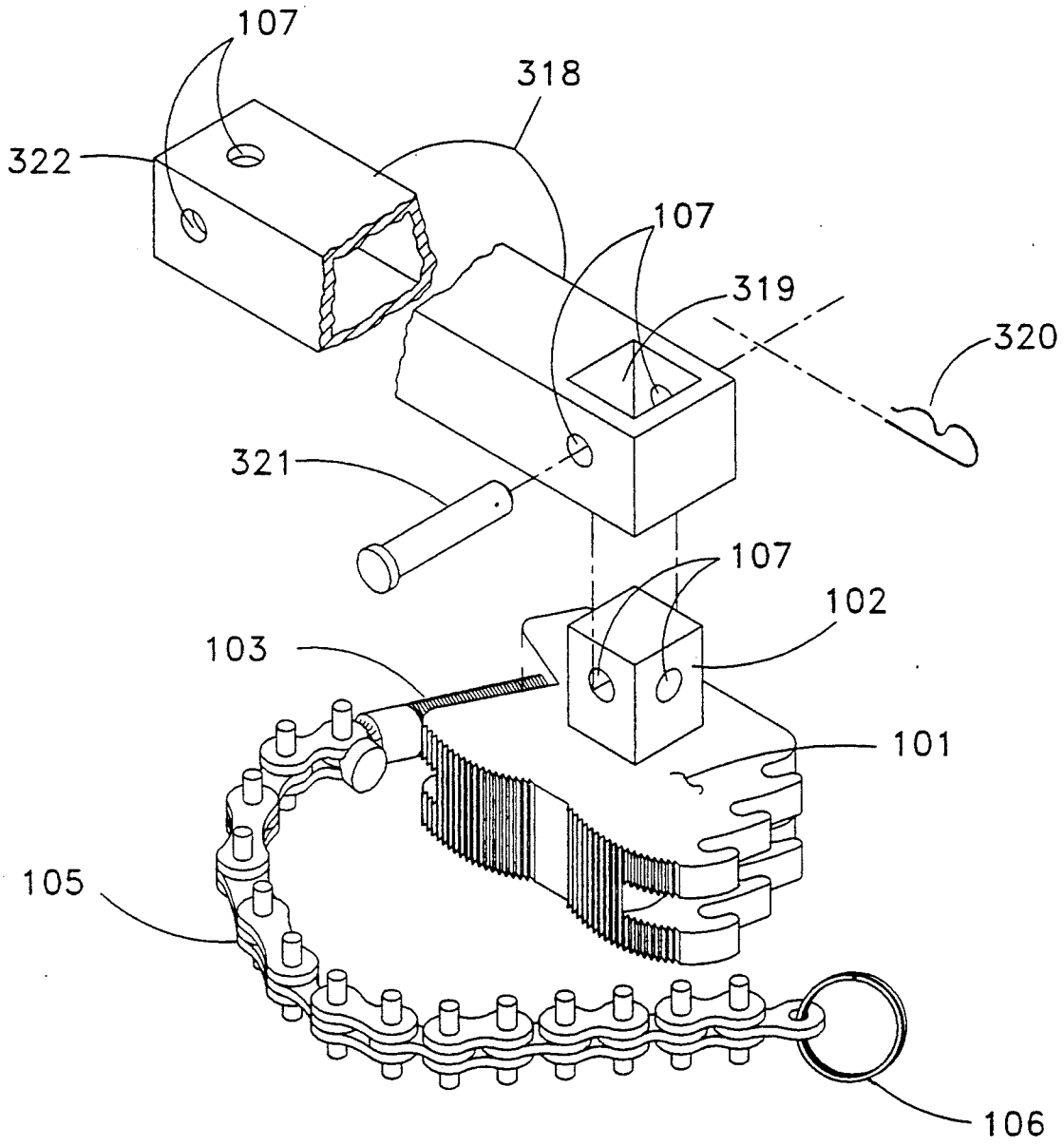
FIG. 3 shows the main body of the universal chain wrench assembled with the standard handle in an exploded view. Also, the standard handle is shown here in one of the offset positions.

FIG. 3, this figure shows the main body of the universal chain wrench assembled. Furthermore, this figure shows the exploded view of standard handle 318 and the connection of the main body and the standard handle 318. Here in this figure, the standard handle is attached to the main body by slipping the attachment hole 319 of the standard handle 318 over the top of the attachment block 102. Once the standard handle 318 is placed over the top of the attachment block 102, optionally there is a attachment pin 321 placed through the first attachment pin hole 107 of the standard handle, through the attachment pin hole 107 of the attachment block 102, and again through the second attachment pin hole 107 of the standard handle 318. Once in position, a cotter key 320 is placed through the end of the attachment pin 321. By doing this, the standard handle 318 is kept in place while the wrench is to be used. This figure shows the standard handle 318 in the "offset" position.

Figure 4:
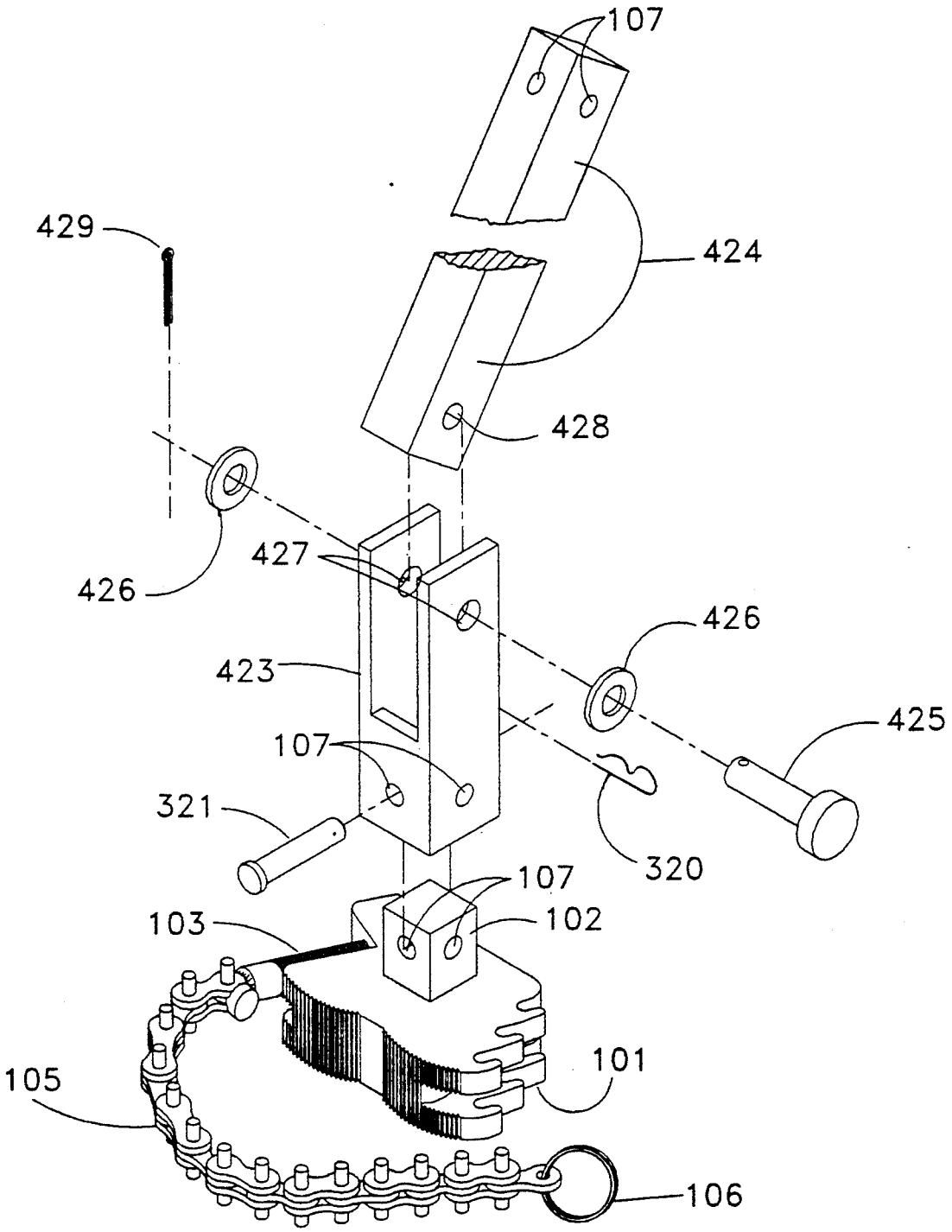
FIG. 4 shows the main body of the universal chain wrench assembled with the universal handle. The view of the universal handle is shown in a exploded view of the handle itself and its connection with the main body of the universal chain wrench.

FIG. 4, this figure shows the main body assembled with the universal handle and the connection of the main body and the universal handle in an exploded view. The universal handle consists of the flex housing 423, handle 424, handle pin 425, cotter pin 429, and 2 flat washers 426. The handle 424 is attached to the flex housing 423 by placing the handle pin 425 through the first flat washer 426, then through the first flex housing hole 427, then through the handle hole 428, through the second flex housing hole 427, and then through the second flat washer 426. Once through these pieces, the handle pin 425 has a cotter pin 429 placed through the end to hold the pin in place. The universal handle is attached to the main body by placing the flex housing 423 over the top of the attachment block 102 and placing the attachment pin 321 through a set of attachment holes 107 and then placing the cotter key 320 through the attachment pin 321. The said universal handle is placed in the "normal" position. Meaning that the handle is placed normal to the work piece. The handle 424 is rotatable about the handle pin 425 thus allowing the universal chain wrench to be used in more places than conventional chain wrenches.

FIGS. 5*a* to 5*d* show the side and the front views of the standard handle and the universal handle. The standard handle 318 has the possibility to being attached to the attachment block 102 of the main block at either the attachment hole 319 or the attachment hole 322. Furthermore, the handle 424 of the universal handle is the same size as the attachment block 102. Thus allowing the end of the handle 424 to be able to fit inside of either attachment hole 319 or 322 of the standard handle thus creating an extension, a T-shape, or L-shape configuration.

FIGS. 5*e* to 5*h* show the side and the top views of the utility block and the side views of the utility nut and the utility bolt. The utility block consists of a utility attachment block 530 and a utility attachment block housing 532. The utility attachment block 530 has a wobble hole 531 drilled through the center to allow for the utility bolt 534 to slip through. The utility attachment housing 532 is to allow the attachment block 102 to slip into it and be held in place by the attachment pin 321 going through the utility blocks attachment pin holes 107 and the attachment block 102 attachment holes 107 of the main body and held in place by the cotter key 320.

FIG. 6, this figure shows two main bodies, two utility blocks 530, a utility bolt 534, a utility nut 533, 2 flat washers 636, a pipe nipple 637, and a pipe coupler 638. One main body is attached to the pipe nipple 637 and is tightened into place by turning the knurl nut 104 until hand tight. While the other said main block is attached to the pipe coupler 638 and is tightened into place by turning it's knurl nut 104 until hand tight. Once this is done and the main blocks are put into position, each main block gets a utility block 530 placed onto it's own attachment block 102 and then an attachment pin 321 (not shown) is paced through and kept in place with a cotter key 320 (not shown) in order to fasten the utility block 530 to it's main body. The utility blocks 530 are placed as shown in FIG. 6. Once the utility blocks 635 are in place a utility bolt 534 is place through the wobbled holes 531 of the two utility blocks 530 with a flat washer 530 placed between the head of the bolt and the first utility block 530 and then another flat washer 530 is placed on after the utility bolt 534 extrudes through the second utility block 530. Then the utility nut 533 is screwed onto the utility bolt 534. The utility nut 533 is to be tightened using a standard socket wrench or an open box end wrench. When the utility nut 533 is being tightened, the utility blocks 530 are being pulled together thus pulling the main bodies together and thus turning the pipe fittings 637 and 638. If the pipe fittings 637 and 638 are still too tight or still need to be tightened some more, it is possible to loosen the utility nut 533 to the point at which the nut is at the end of the utility bolt 534, loosen one of the main blocks by loosening the knurl nut 104 thus allowing the adjustable chain tightener bolt to move, therefore allowing the loosened main body to move to the point at which the utility blocks 530 are spread apart till the utility bolt 534 and utility nut 533 assembly hits the sides outer sides of the utility blocks 530. Then tightened down the adjustable chain tightener bolt 103 with the knurl nut 104 thus tightening the main body back to the pipe fitting. Once this is done, the utility nut 533 may be tightened again using a standard socket wrench or a open box end wrench. Hence, pulling the two main bodies together again and creating the pipe fittings to turn. This process may be repeated for as many times as required. This allows one person to tighten or loosen pipe fittings by oneself depending on how the main bodies and the utility blocks are configured.

SUMMARY, RAMIFICATIONS, AND SCOPE

Accordingly, the reader will see that my invention of the universal chain wrench and accessory tools can be used in a number of ways that the previous chain wrenches are unable to be used. In addition to the universal chain wrench being used as an convention chain wrench, it can be used in small work areas and tightening and loosening threaded pipe fittings by only having to have one person without the possibility of disturbing other pipe connections somewhere else. Furthermore, this invention allows the ability of being able to remove it's handles and replace them with different size and types of handles. Also, this invention allows the ability to change the handles configuration whether it be in either an offset position or an normal position, a T-handle configuration, L-handle configuration or whatever is required.

Although the description above contains many configurations of the handles and utility blocks, these should not be construed as limiting the scope of the invention but as merely providing illustrations of some of the presently preferred configurations of this invention. For example the handles may be configured in a T-shaped form, L-shaped form; the handles and the attachment block may not be square but they may have other shapes such as oval, round, hexagon, etc; the utility bolt and nut may be replaced by a hydraulic ram; the size of the main body may change, etc.

Thus the scope of the invention should be determined by the appended claims and their legal equivalents, rather than by the examples given.

I claim:

1. A chain wrench for engagement around the circumference of a threaded workpiece such as a pipe and the like and disposed at a right angle to a length of the workpiece, the chain wrench used for tightening the threaded workpiece on a threaded coupler and used for loosening the threaded workpiece on the threaded coupler, the chain wrench comprising:

a chain wrench body having a top portion, a bottom portion, a front portion, a rear portion, a first side and a second side, the front portion of said body having a plurality of teeth for releasably engaging a portion of the workpiece;

a chain having a first end and a second end, the first end of said chain attached on the first side of said wrench body, the second end of said chain releasably mounted on the second side of said wrench body, whereby said chain is adapted for receipt around different circumferences of the workpiece;

a first attachment block having exterior sides therearound and extending upwardly from the top portion of said wrench body; said attachment block having attachment pin holes therethrough for receiving an attachment pin; and a first handle having a first end and a second end, the first end of said first handle adapted for receipt on said first attachment block, whereby said first handle includes orienting means such that when secured to said first attachment block may be disposed at a right angle to the length of the workpiece, parallel to the length of the workpiece at an angle to the length of the workpiece.

2. The chain wrench as described in claim 1 further including a second attachment block extending downwardly from the bottom portion of said wrench body.

3. The chain wrench as described in claim 1 wherein the first end of said first handle has an opening therein, the opening in the first end adapted for receipt around the exterior sides of said first attachment block.

4. The chain wrench as described in claim 3 wherein said orienting means include the first end of said first handle being adjustable on said first attachment block for holding said first handle at various positions and at right angles to the length of the workpiece.

5. The chain wrench as described in claim 4 further including a second handle, said second handle having a first end and a second end, the first end of said second handle adapted for receipt on the second end of said first handle for providing increased handle length and improved leverage.

6. The chain wrench as described in claim 1 further including a second handle having a first end and a second end, the first end of said second handle adapted for receipt on the second end of said first handle.

7. The chain wrench as described in claim 1 wherein the first end of said chain includes tightening means for tightening said chain on said wrench body when the workpiece is therebetween.

8. The chain wrench as described in claim 7 wherein said tightening means is a threaded bolt received through a bolt hole in the first side of said wrench body, an end of said threaded bolt receiving a knurl nut.

9. The chain wrench as described in claim 1 wherein said second side of said wrench body includes a plurality of spaced apart hooks, the second end of said chain adjustably mounted on a selected hook, said hooks allowing for adjustment of a length of said chain around the circumference of the workpiece.

10. The chain wrench as described in claim 1 wherein the front portion of said body includes two sets of teeth, one set of teeth gripping the side of the workpiece when the chain wrench is rotated in a first direction and the other set of teeth gripping the side of the workpiece when the chain wrench is rotated in a second direction.

11. A chain wrench for engagement around the circumference of a threaded workpiece such as a pipe and the like and disposed at a right angle to a length of the workpiece, the chain wrench used for tightening the threaded workpiece on a threaded coupler and used for loosening the threaded workpiece on the threaded coupler, the chain wrench comprising:

a chain wrench body having a top portion, a bottom portion, a front portion, a rear portion, a first side and a second side, the front of said body having a plurality of teeth for releasably engaging a portion of the workpiece;

a chain having a first end and a second end, the first end of said chain adjustably tightened on the first side of said wrench body, the second end of said chain releasably mounted on the second side of said wrench body, whereby said chain is adapted for receipt around different circumferences of the workpiece;

a first attachment block having exterior sides therearound and extending upwardly from the top portion of said wrench body; said attachment block having attachment pin holes therethrough for receiving an attachment pin; and a first handle having a first end and a second end, the first end of said first handle adapted for receipt on said first attachment block, whereby said first handle includes orienting means such that when secured to said first attachment block may be disposed at a right angle to the length of the workpiece, parallel to the length of the workpiece or at an angle to the length of the workpiece.

12. A chain wrench for engagement around the circumference of a threaded workpiece such as a pipe and the like and disposed at a right angle to a length of the workpiece, the chain wrench used for tightening the threaded workpiece on a threaded coupler and used for loosening the threaded workpiece on the threaded coupler, the chain wrench comprising, first and second chain wrench bodies each having a top portion, a bottom portion, a front portion, a rear portion, a first side and a second side, the front portion of each of said bodies having a plurality of teeth for releasably engaging a portion of the workpiece;

first and second chains each having a first end and a second end, the first end of each chain attached on the first side of a respective wrench body, the second end of each chain releasably mounted on the second side of a respective wrench body, whereby each of said chains is adapted for receipt around different circumferences of the workpiece;

a first attachment block having exterior sides therearound and extending upwardly from the top portion of each of said wrench bodies;

a second attachment block having exterior sides therearound and extending downwardly from the bottom portion of each of said wrench bodies, a utility block on each of said second attachment blocks; and said first wrench body secured to the workpiece, said second wrench body secured to the coupler, said utility block on said second attachment block of said first wrench body connected to said utility block on said second attachment block of said second wrench body by a utility bolt, whereby when said utility bolt is tightened on said utility blocks the workpiece may be tightened and loosened on the coupler.

* * * * *